US008735812B2

(12) United States Patent
Köster

(10) Patent No.: US 8,735,812 B2
(45) Date of Patent: May 27, 2014

(54) KINGDON ION TRAPS WITH HIGHER-ORDER CASSINI POTENTIALS

(75) Inventor: Claus Köster, Lilienthal (DE)

(73) Assignee: Bruker Daltonik GmbH, Bremen (DE)

( * ) Notice: Subject to any disclaimer, the term of this patent is extended or adjusted under 35 U.S.C. 154(b) by 182 days.

(21) Appl. No.: 13/334,191

(22) Filed: Dec. 22, 2011

(65) Prior Publication Data

US 2012/0181423 A1 Jul. 19, 2012

(30) Foreign Application Priority Data

Jan. 17, 2011 (DE) ..... 10 2011 008 713

(51) Int. Cl.
*H01J 49/26* (2006.01)
*H01R 43/00* (2006.01)

(52) U.S. Cl.
USPC ..... 250/288; 250/292; 250/282

(58) Field of Classification Search
USPC ..... 250/281, 282, 287, 290, 288
See application file for complete search history.

(56) References Cited

U.S. PATENT DOCUMENTS

| | | | | |
|---|---|---|---|---|
| 5,886,346 | A | 3/1999 | Makarov | |
| 7,994,473 | B2 | 8/2011 | Koster | |
| 8,080,788 | B2 * | 12/2011 | Stoermer | 250/293 |
| 8,319,180 | B2 * | 11/2012 | Nikolaev et al. | 250/290 |
| 2001/0035498 | A1 * | 11/2001 | Li et al. | 250/398 |
| 2004/0004185 | A9 * | 1/2004 | Guevremont et al. | 250/287 |
| 2005/0098723 | A1 * | 5/2005 | Farnsworth | 250/291 |
| 2005/0121609 | A1 * | 6/2005 | Makarov et al. | 250/290 |
| 2005/0151072 | A1 * | 7/2005 | Guevremont et al. | 250/282 |
| 2008/0315080 | A1 * | 12/2008 | Makarov et al. | 250/281 |
| 2009/0294656 | A1 * | 12/2009 | Koster | 250/283 |
| 2010/0108880 | A1 * | 5/2010 | Stoermer | 250/283 |
| 2010/0301204 | A1 * | 12/2010 | Koster et al. | 250/283 |
| 2011/0042562 | A1 * | 2/2011 | Koster | 250/283 |
| 2011/0284741 | A1 * | 11/2011 | Stoermer et al. | 250/292 |
| 2012/0043461 | A1 * | 2/2012 | Nikolaev et al. | 250/282 |
| 2012/0091332 | A1 * | 4/2012 | Makarov et al. | 250/282 |
| 2012/0138785 | A1 * | 6/2012 | Makarov et al. | 250/282 |
| 2012/0193529 | A1 * | 8/2012 | Nikolaev et al. | 250/282 |
| 2013/0075602 | A1 * | 3/2013 | Stoermer | 250/283 |

* cited by examiner

*Primary Examiner* — Nikita Wells
*Assistant Examiner* — Johnnie L Smith
(74) *Attorney, Agent, or Firm* — Robic, LLP

(57) ABSTRACT

An electrostatic Kingdon ion trap in which ions can oscillate harmonically in the longitudinal direction, decoupled from their motions in the transverse direction is formed from at least three inner electrodes located inside a hollow outer housing electrode. The inner surface of the housing electrode and the outer surfaces of the inner electrodes are formed so that when a potential is applied between the housing and the inner electrodes, the potential distribution inside the housing contains not only a term for a harmonic potential well in the axial direction, but also a term for the potential distribution in the radial direction, that contains, independent of the axial coordinate, the equations for a family of Cassini curves of at least the third order.

9 Claims, 4 Drawing Sheets

KINGDON ION TRAPS WITH HIGHER-ORDER CASSINI POTENTIALS

BACKGROUND

The invention relates to electrostatic Kingdon ion traps in which ions can oscillate harmonically in the longitudinal direction, decoupled from their motions in the transverse direction. Kingdon ion traps are electrostatic ion traps in which ions can orbit around one or more inner longitudinal electrodes or oscillate in the center plane between inner longitudinal electrodes, while an outer, enclosing housing is at a DC potential which the ions with a specified kinetic energy cannot reach. A very simple Kingdon ion trap consists of a rod (in the ideal case, an infinitely long rod) as the inner electrode and a surrounding tube as the housing or outer electrode (FIG. 1). In special Kingdon ion traps which are particularly suitable for mass spectrometers, the inner surfaces of the housing electrodes and the outer surfaces of the inner electrodes are shaped so that, firstly, the motions of the ions in the longitudinal direction (z) of the Kingdon ion trap are decoupled from their motions in the transverse direction (x, y) or (r, ϕ) and, secondly, a parabolic potential profile is generated in the longitudinal direction in which the ions can oscillate harmonically.

In this document, the term "Kingdon ion traps" refers only to these special forms in which ions can oscillate harmonically in the longitudinal direction, decoupled from their motions in the transverse direction.

The document U.S. Pat. No. 5,886,346 (A. A. Makarov) elucidates the fundamentals of a special Kingdon ion trap which was introduced by Thermo-Fischer Scientific GmbH Bremen under the name Orbitrap®. This ion trap consists of a housing electrode which is split across the center and a single spindle-shaped coaxial inner electrode (FIGS. 2 and 3). The housing electrode has an ion-repelling electric potential and the inner electrode an ion-attracting electric potential. With the aid of a special ion-optical device and a special injection method, the ions are tangentially injected through an opening in the housing electrode and then orbit in the hyperlogarithmic electric potential of the ion trap. The kinetic injection energy of the ions is set so that the attractive forces and the centrifugal forces are in balance, and the ions therefore largely move on virtually circular trajectories.

The cross-sections of the inner surface of the housing electrodes and the outer surfaces of the inner electrodes are both circular. The hyperlogarithmic potential between inner and outer electrodes is represented by $$\Psi_{Orbitrap}(r, \phi, z)=\Psi_1 z^2/l_1^2-\Psi_1 r^2/2l_1^2+2\Psi_2 ln(r/l_2)+\Psi_3.$$

In the document U.S. Pat. No. 7,994,473 B2 (C. Köster; correspondent to DE 10 2007 024 858 B4 and GB 2448413 B), which is incorporated herein by reference, other types of Kingdon ion trap are described which, in their basic form, have precisely two inner electrodes (FIG. 4). In this case, as well, the inner electrodes and the outer housing electrodes can be precisely shaped in such a way that a potential distribution is formed in which the longitudinal motions are decoupled from the transverse motions, and a parabolic potential well is created in the longitudinal direction to generate a harmonic oscillation. The potential of this "bipolar Cassini ion trap" is represented in a general form by $$\Psi(r, \phi, z)=\Psi_1 z^2/l_1^2-\Psi_1\{r^2(1-k)\sin^2\phi+k\cos^2\phi)/l_1^2\}+\Psi_2 ln\{(r^4-2b^2r^2\cos(2\phi)+b^4)/l_2^4\}+\Psi_3.$$

With this potential distribution, the exact inner shapes of the housing electrodes and the outer shapes of the inner electrodes are described by two fixed values for $\Psi(r,\phi, z)=\Psi_{Outer}$ and $\Psi(r, \phi, z)=\Psi_{Inner}$ because each of these must form equipotential surfaces of the desired field. These "bipolar Cassini ion traps" or "second-order Cassini ion traps" are characterized by the fact that the ions not only fly on complicated trajectories around the two inner electrodes, but can also oscillate in the center plane between the two inner electrodes. The ions orbiting around or oscillating between the electrodes in this way can then execute harmonic oscillations in the longitudinal direction.

Bipolar Cassini curves are curves in a plane, which can be defined like plane ellipses. While an ellipse is the quantity of all points whose distances $a_l$ and $a_2$ from two focal points result in a constant sum s ($a_1+a_2=s$), a Cassini curve is the quantity of all points whose distances $a_l$ and $a_2$ from two focal points (called "poles" here) result in a constant product $p:a_1\times a_2=p$. In the same way as ellipses degenerate to circles if the two foci coincide to form one focus, Cassini curves also degenerate to circles if the two poles coincide to form one pole. Ellipses form a concentric family of curves with s as the family parameter. As shown in FIG. 6, Cassini curves form a family of curves which form ellipse-like curves around the two poles for large values of p; if p becomes smaller, the curves begin to constrict. With even smaller p, a lemniscate is formed, and for even smaller values of p the Cassini curve splits into two closed curves which each surround one pole. The cross-section of the housing of the bipolar Cassini ion trap is described by a large value of p, the cross-section of the two inner electrodes by a small value for p.

The term $\Psi_2 \ln\{(r^4-2b^2r^2\cos(2\phi)+b^4)/l_2^4\}$ contains, in the curly brackets, the equation for a family of Cassini curves; the term $\Psi_1 z^2/l^2$ represents the axial potential well, which is independent of r and ϕ. The term $\Psi_1\{r^2(1-k)\sin^2\phi+k\cos^2\phi)/l_1^2\}$, which modifies the radial potential distribution, is included so that the Laplace condition $\nabla^2\Psi=0$ is fulfilled, which must apply to all potential distributions.

By superimposing the potentials of several bipolar Cassini ion traps with suitable twists and shifts, it is possible to design ion traps with three, four and more inner electrodes, as is stated in the document U.S. Pat. No. 7,994,473 B2. These still belong to the class of second-order Cassini ion traps, however.

In contrast to ellipses, the Cassini curves can be expanded to n-polar curves. These curves are the quantities of all points in a plane whose distances $a_i$(i=1 . . . n) from the n poles result in constant products $p:\Pi_{i=1}^{i=n}(a_i)=p$ . These n-polar Cassini curves are also called Cassini curves of the nth order. These also include curves which surround all poles together, as well as n curves which each surround one pole. FIGS. 5, 6 and 7 illustrate families of Cassini curves of the first, second and third order.

In view of the above there is a need to find further electrostatic ion traps in which ions can oscillate harmonically in the longitudinal direction, decoupled from their motions in the transverse direction.

SUMMARY

In accordance with the principles of the invention, a Kingdon ion trap comprises n inner electrodes and one outer electrode and the electrodes create a potential distribution of the form $$\Psi(r, \phi, z)=\Psi_1 z^2/l_1^2-\Psi_1 r^2(1-k)\sin^2\phi+k\cos^2\phi)/l_1^2+\Psi_2 ln\{(r^{2n}-2b^n r^n\cos(n\phi)+b^{2n})/l_2^{2n}\}+\Psi_3$$

with n≥3 and b≠0. The potential distribution can be split up into the form $\Psi(r, \phi, z)=\Psi_z+\Psi_{Lapl}+\Psi_{Cass}+\Psi_3$, where the term $\Psi_z=\Psi_1 z^2/l_1^2$ represents the harmonic potential well in the axial direction, and the term $\Psi_{Cass}=\Psi_2 \ln\{(r^{2n}=2b^n r^n \cos(n\phi)+b^{2n})/l_2^{2n}\}$ represents the determining part of the radial distributions of the potential; this contains the equation for a family of nth-order Cassini curves in the curly brackets. The term $\Psi_{Lapl}=-\Psi_1 r^2(1-k)\sin^2\phi+k\cos^2\phi)/l_1^2$ which is independent of z must be added so that the total potential fulfills the Laplace condition $\nabla^2\Psi=0$. With given values for the potential constants $\Psi_1$, $\Psi_2$ and $\Psi_3$, for the numerical constants k and n (with $n\geq 3$), and for the length parameters b (with $b\neq 0$), $l_1$ (a length parameter for a longitudinal elongation) and $l_2$ (a length parameter for the transverse dimensions of inner and outer electrodes), it is possible, by suitable selection of two specific, fixed values for the potential $\Psi(r, \phi, z)$, to obtain the potential surfaces of the inner surface of the outer electrode and the outer surfaces of the inner electrodes, which must be equipotential surfaces, of course. Kingdon ion traps with a potential distribution of this form fulfill the condition that ions can oscillate harmonically in the axial z-direction independently of their motion in the radial direction.

More complex ion traps are obtained if further Cassini potential distributions of the first, second or higher order are superimposed in an appropriate way on higher-order potential distributions.

The trajectories of the ions within the ion trap in planes perpendicular to the z-axis can be extraordinarily complicated. In addition to trajectories which orbit around all the inner electrodes, more complex, cycloidal trajectories can also occur which orbit all or some of the inner electrodes in turn. Thus ion traps with three inner electrodes can bring about trajectories in the form of a three-leafed clover; in ion traps with four inner electrodes, the trajectories can even resemble double-bladed propellers (lemniscates) or a four-leafed clover. With even numbers of electrodes it is also possible for the ions to oscillate through one of the center planes.

In this illustration the ions execute oscillations (19) in the center plane between the two spindle-shaped inner electrodes.

Figure 1:
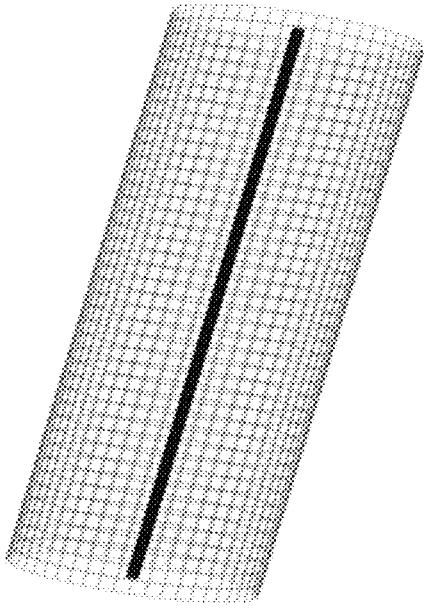
FIG. 1 (Prior Art)
FIG. 1 shows the ion trap originally presented by Kingdon (1923), which is, however, open in the z-direction and does not fulfill the condition that ions should be able to oscillate harmonically in the z-direction.
Figure 2:
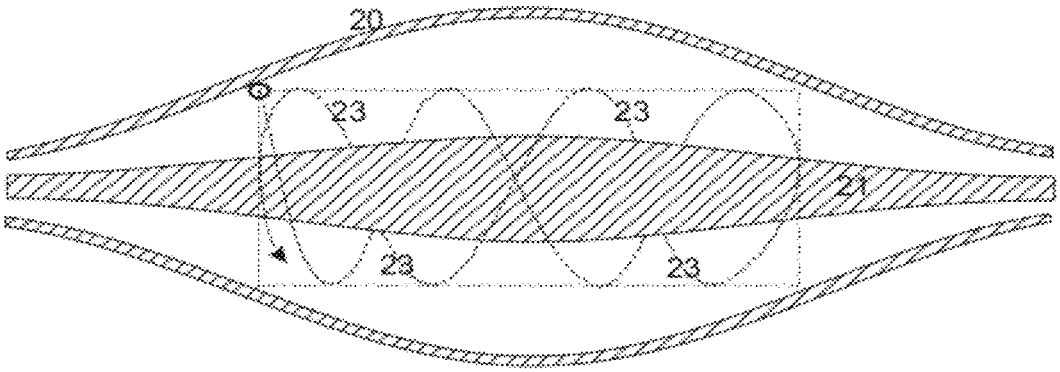
FIG. 2 (Prior Art)
FIG. 2 depicts a Kingdon ion trap according to A. A. Makarov (U.S. Pat. No. 5,886,346) with housing electrode (20) and inner spindle electrode (21). In the interior of the ion trap, the ions follow motion trajectories (23) which appear circular in the transverse direction, but also oscillate harmonically in the longitudinal direction at the same time.
Figure 3:
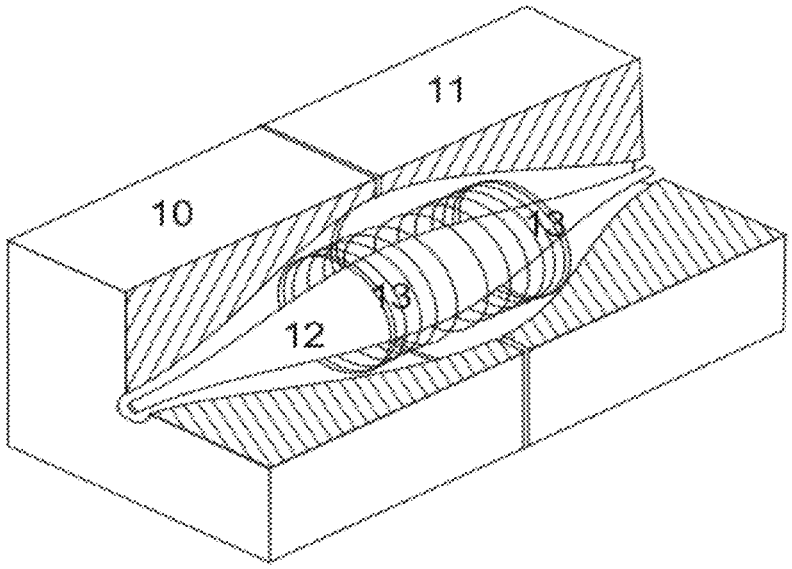
FIG. 3 (Prior Art)
FIG. 3 shows this ion trap according to A. A. Makarov in three-dimensional representation with the motion trajectories (13) of the ions around the inner electrode (12) in the centrally split housing (10, 11).
Figure 4:
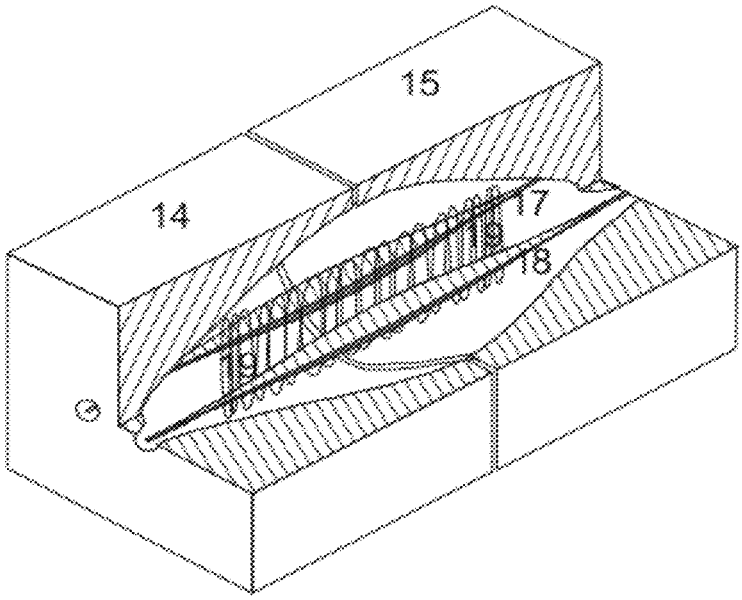
FIG. 4 (Prior Art)
FIG. 4 shows an electrostatic second-order Cassini ion trap according to C. Köster (U.S. pat. No. 7,994,473 B2) in three-dimensional representation with a housing centrally split into two halves (14, 15) and two spindle-shaped inner electrodes (17, 18).
Figure 5:
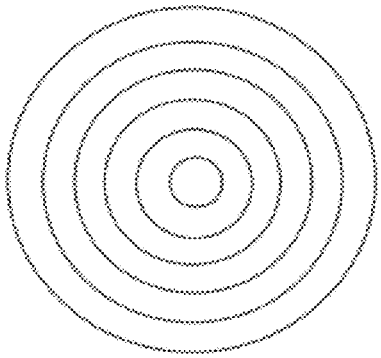
Figure 6:
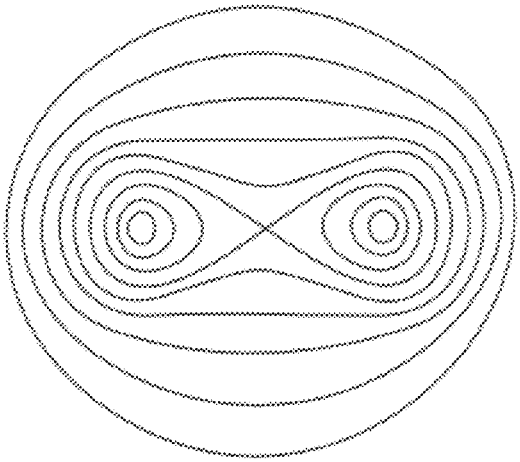
Figure 7:
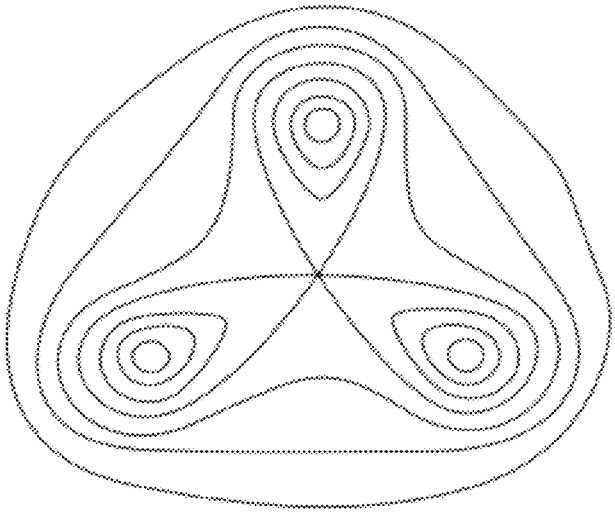

FIGS. 5, 6 and 7 illustrate Cassini curves of the first, second and third order (also called unipolar, bipolar and tripolar Cassini curves).

Figure 8:
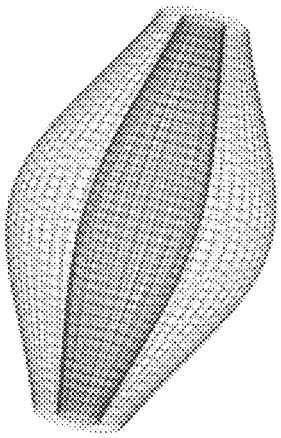
FIG. 8 (Prior Art)
Figure 9:
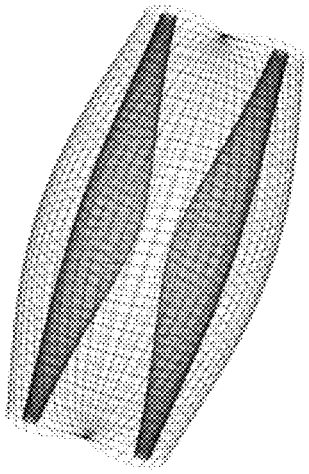
FIG. 9 (Prior Art)
Figure 10:
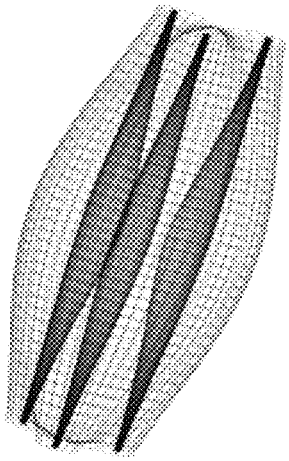

FIGS. 8, 9 and 10 illustrate the basic types of the various Cassini ion traps of the first, second and third order in three-dimensional representation. Only the third-order Cassini ion trap in FIG. 10 belongs to the Kingdon ion traps of the present invention.

Figure 11:
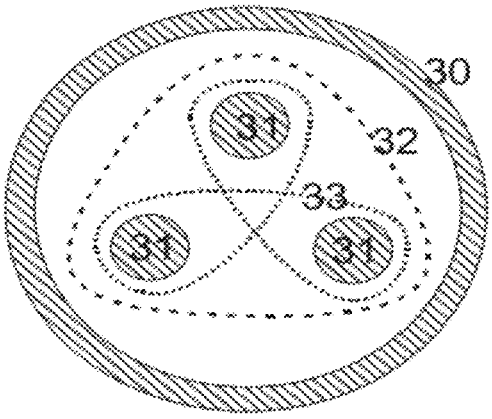

FIG. 11 schematically depicts two radial forms of ion trajectories (32) and (33) in a third-order Cassini ion trap with three inner electrodes (31) in a housing electrode (30). The electrode cross-sections drawn as circles here are approximately circular only for very large and very small family parameters; otherwise they deviate greatly from circles, as shown in FIG. 6.

Figure 12:
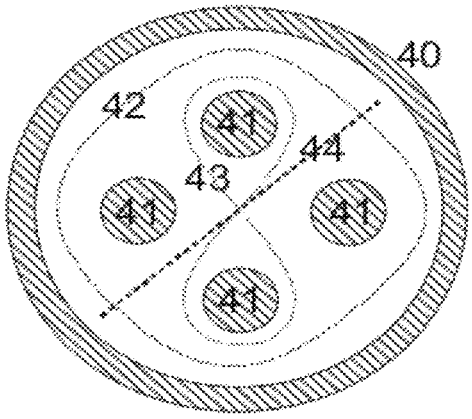

FIG. 12 schematically depicts three different forms of ion trajectory (42), (43) and (44) in a fourth-order Cassini ion trap with four inner electrodes (41) in a housing electrode (40). Particularly interesting is the oscillatory motion (44) in the center plane between two pairs of inner electrodes. There are further types of trajectory form. Here also, the cross-sections of the electrodes are drawn as circles for simplicity. The true cross-sections can be seen in FIG. 7.

DETAILED DESCRIPTION

The invention concerns Kingdon ion traps in which the ions can oscillate harmonically in the longitudinal z-direction as required, decoupled from any type of motion they may have in the transverse direction, but which have at least three inner longitudinal electrodes within an outer housing electrode, and whose radial potential distributions have components which follow Cassini families of curves of at least the third order.

The inner shape of the housing electrode and the outer shape of the inner electrodes must be chosen so that in the interior of the housing a potential distribution is created of the general form $$\Psi(r, \phi, z)=\Psi_1 z^2/l_1^2-\Psi_1 r^2((1-k)\sin^2\phi+k\cos^2\phi)/l_1^2+\Psi_2 ln\{(r^{2n}-2b^n r^n\cos(n\phi)+b^{2n})/l_2^{2n}\}+\Psi_3,$$

where $b\neq 0$ and $n\geq 3$. The number n of poles must naturally be an integer. The potential constants $\Psi_1$, $\Psi_2$ and $\Psi_3$, the numerical constants k, n and the length constants b, $l_1$ and $l_2$ are freely selectable within their limitations. The length $l_1$ is a stretching factor in the z-direction, the length $l_2$ a radial dimensional factor for the Cassini curves. After all these parameters have been specified, the next step is, as any person skilled in the art knows, to select two suitable values for the constant potentials $\Psi(r, \phi, z)=\Psi_{outer}$ and $\Psi(r, \phi, z)=\Psi_{inner}$ and thereby to obtain the equations for the equipotential surfaces of the inner surface of the housing electrodes and the outer surfaces of the inner electrodes, since these must, of course, be equipotential surfaces.

The equations for the inner surface of the housing electrodes and for the outer surfaces of the inner electrodes can be used to manufacture the ion traps in modern machining centers. Kingdon ion traps with a potential distribution of this form fulfill the condition that ions can oscillate harmonically in the axial z-direction independently of their motion in the radial direction.

The potential distribution can be split up in the form $\Psi(r, \phi, z)=\Psi_z+\Psi_{Lapl}+\Psi_{Cass}+\Psi_3$, where the term $\Psi_z=\Psi_1 z^2/l_1^2$ represents the harmonic potential well in the axial direction, and the term $\Psi_{Cass}=\Psi_2 \ln\{(r^{2n}-2b^n r^n\cos(n\phi)+b^{2n})/l_2^{2n}\}$ represents the determining part of the radial distributions of the potential; this term contains the nth-order family of Cassini curves in the curly brackets. The term $\Psi_{Lapl}=-\Psi_1 r^2(1-k)\sin^2\phi+k\cos^2\phi)/l_1^2$, which is independent of z, must be added so that the total potential fulfills the Laplace condition $\nabla^2\Psi=0$. If the parameter $k=1/2$ is selected in this term, then the term simplifies to $\Psi_{Lapl}=-\Psi_1 r^2/2l_1^2$. This simplified term is radially symmetric in r, and causes potential distributions to be described which are formed by n inner electrodes of the same cross-section evenly distributed on a circle with corresponding rotation. The resulting ion trap thus has n-fold rotational symmetry; each rotation through the angle 360° ln causes the shape to transform into itself.

FIG. 10 depicts a third-order Cassini ion trap according to the invention, where the surfaces of the electrodes are represented as grids.

Kingdon ion traps are electrostatic ion traps. A constant operating voltage ΔU of several kilovolts is usually applied between the housing electrodes, on the one hand, and the inner electrodes, on the other hand. Ions of specified kinetic energy can then follow quite different types of trajectory in the r-ϕ-plane of the higher-order Cassini ion traps. FIG. 11 schematically illustrates two different forms of trajectory for a third-order Cassini ion trap with three regularly arranged inner electrodes: one trajectory which encircles all three inner electrodes, and one trajectory which winds cycloidally around the three inner electrodes. FIG. 12 schematically depicts the cross-section of a Cassini ion trap with four inner electrodes, which have a regular arrangement here also (k=½). Three types of ion trajectory are given here: trajectory (42) encircles all the inner electrodes in one orbit; trajectory (43) winds in the form of a lemniscate around only two of the four inner electrodes; and trajectory (44) represents an oscillatory motion in the center plane between two pairs of inner electrodes. There are also other forms of trajectory. It should be stated here that the cross-sections of the electrodes shown here as circles are in reality not circular; their shape can even deviate very strongly from a circle, depending on the choice of $l_2$, as shown in FIGS. 6 and 7.

The inner electrodes do not need to have a regular arrangement. The arrangements of the inner electrodes can be distorted within certain limits by a parameter k≠½. In addition, more complex potential distributions can be generated by appropriate superimpositions with further Cassini potentials of the first, second or higher orders.

In the description above, it is always assumed that the n inner electrodes are at the same potential and therefore must have the same cross-section (apart from a rotation through 360° ln). This does not have to be the case in general. It is possible to determine n different forms by means of n different potentials for the inner electrodes; when the different potentials are applied, the forms will then again generate the required overall potential distribution.

The Kingdon ion traps with higher-order Cassini potential distributions according to the invention can be used as ion traps for Fourier transform mass spectrometers, as can the ion traps described in the documents U.S. Pat. No. 5,886,346 (A. A. Makarov) and U.S. Pat. No. 7,994,473 B2 (C. Köster); in this case the image currents induced by the axial oscillations of the ions in the then halved housing electrodes (or halved inner electrodes) are measured and suitably processed to give mass spectra. The electrodes can also be divided into more than two insulated partial segments in order to detect oscillations of a higher order.

The introduction of the ions into the ion trap is difficult because it must coincide with a change of the ratio of the kinetic energy of the ions to the potential difference between inner and housing electrodes in order that the ions in the interior cannot reach the housing electrodes. The ions can, for example, be introduced as described in the document US 2010/0301204 A1 (C. Köster; correspondent to DE 10 2009 020 886 A1 and GB 2470259 A).

While the invention has been shown and described with reference to a number of embodiments thereof, it will be recognized by those skilled in the art that various changes in form and detail may be made herein without departing from the spirit and scope of the invention as defined by the appended claims.

What is claimed is:

1. A Kingdon ion trap comprising:

a housing electrode; and at least n inner electrodes, which are formed and arranged so that when a potential difference is applied between the housing and the inner electrodes, a radial electric potential distribution $\Psi_{rad}$ is created, which is determined by equations for Cassini curves of the order n greater than, or equal to, three, and an overall electric potential distribution Ψ in polar coordinates (r, ϕ, z) corresponds to the form $$\Psi(r;\phi,z)=\Psi_1 z^2/l_1^2-\Psi_1 r^2((1-k)\sin^2\phi+k\cos^2\phi)/l_1^2+\Psi_2 ln\{(r^{2n}-2b^n r^n\cos(n\phi)+b^{2n})/l_2^{2n}\}\Psi_3$$

with b≠0 and n≥3, n being an integer, where $\Psi_1$, $\Psi_2$, $\Psi_3$, $l_1$, $l_2$, k, n and b are all constants which are freely selectable within respective limitations.

2. The Kingdon ion trap of claim 1, wherein a selection of two constant potential values $\Psi(r,\phi,z)=\Psi_{outer}$ and $\Psi(r,\phi,z)=\Psi_{inner}$ describe equipotential surfaces, which form inner surfaces of the housing electrode and outer surfaces of the inner electrodes.

3. The Kingdon ion trap of claim 1, wherein in the z direction one of the housing electrode and at least one of the n inner electrodes is divided into at least two parts which are insulated from each other.

4. The Kingdon ion trap of claim 1 wherein the radial electric potential distribution $\Psi_{rad}$ has at least one further Cassini potential distribution of the first, second or higher order superimposed on it.

5. A mass spectrometer comprising:

an ion source;

a Kingdon ion trap having a housing electrode and at least n inner electrodes, which are formed and arranged so that when a potential difference is applied between the housing and the inner electrodes, a radial electric potential distribution $\Psi_{rad}$ is created, which is determined by equations for Cassini curves of the order n greater than, or equal to, three, and an overall electric potential distribution Ψ in polar coordinates (r, ϕ, z) corresponds to the form $$\Psi(r;\phi,z)=\Psi_1 z^2/l_1^2-\Psi_1 r^2((1-k)\sin^2\phi+k\cos^2\phi)/l_1^2+\Psi_2 ln\{(r^{2n}-2b^n r^n\cos(n\phi)+b^{2n})/l_2^{2n}\}\Psi_3$$

with b≠0 and n≥3, n being an integer, where $\Psi_1$, $\Psi_2$, $\Psi_3$, $l_1$, $l_2$, k, n and b are all constants which are freely selectable within respective limitations; and a detector that detects ion oscillations in the Kingdon ion trap.

6. The mass spectrometer of claim 5, wherein a selection of two constant potential values $\Psi(r,\phi,z)=\Psi_{outer}$ and $\Psi(r,\phi,z)=\Psi_{inner}$ describe equipotential surfaces, which form inner surfaces of the housing electrode and outer surfaces of the inner electrodes.

7. The mass spectrometer of claim 5, wherein in the z direction one of the housing electrode and at least one of the n inner electrodes is divided into at least two parts which are insulated from each other.

8. The mass spectrometer of claim 5 wherein the radial electric potential distribution $\Psi_{rad}$ has at least one further Cassini potential distribution of the first, second or higher order superimposed on it.

9. A method for manufacturing a Kingdon ion trap having a hollow housing electrode and at least n inner electrodes located inside the housing electrode, the method comprising:

(a) forming the housing electrode from a conductive material having an inner surface that conforms to an equation $\Psi(r,\phi,z)$ equal to a first constant potential value; and (b) forming each of the n inner electrodes from a conductive material having an outer surface that conforms to an equation $\Psi(r,\phi,z)$=a second constant potential value, where $$\Psi(r,\phi,z)=\Psi_1 z^2/l_1^2-\Psi_1 r^2((1-k)\sin^2\phi+k\cos^2\phi)/l_1^2+\Psi_2 ln\{(r^{2n}-2b^n r^n\cos(n\phi)+b^{2n})/l_2^{2n}\}\Psi_3$$

with $b\neq 0$ and $n\geq 3$, n being an integer, where $\Psi_1$, $\Psi_2$, $\Psi_3$, $l_1$, $l_2$, k, n and b are all constants which are freely selectable within respective limitations.

* * * * *